US005425425A

United States Patent [19]

Bankston et al.

[11] Patent Number: 5,425,425

[45] Date of Patent: Jun. 20, 1995

[54] METHOD AND APPARATUS FOR REMOVING GAS LIFT VALVES FROM SIDE POCKET MANDRELS

[75] Inventors: Douglas P. Bankston, Hammond; Keith Fry, Des Allemands; Chester Guidry, Slidell, all of La.

[73] Assignee: Cardinal Services, Inc., New Orleans, La.

[21] Appl. No.: 236,386

[22] Filed: Apr. 29, 1994

[51] Int. Cl.[6] ..... E21B 7/06

[52] U.S. Cl. ..... 166/377; 166/117.5

[58] Field of Search ..... 166/117.5, 117.6, 117.7, 166/377, 381

[56] References Cited

U.S. PATENT DOCUMENTS

| | | | |
|---|---|---|---|
| 3,752,231 | 8/1973 | McGowen, Jr. et al. | 166/117.5 |
| 3,876,001 | 4/1975 | Goode | 166/117.5 |
| 3,891,032 | 6/1975 | Tausch et al. | 166/117.5 |
| 4,294,313 | 10/1981 | Schwegman | 166/117.5 |
| 4,452,305 | 6/1984 | Schwendemann | 166/117.5 |

OTHER PUBLICATIONS

Camco Gas Lift Product Catalog, Copyright 1987.

*Primary Examiner*—William P. Neuder

*Attorney, Agent, or Firm*—Pravel, Hewitt, Kimball & Krieger

[57] ABSTRACT

A method and apparatus for removing gas lift valves when the valve is stuck in a side pocket mandrel positioned in an oil and gas well. The method includes the running of an elongated tool body into the well on a slick line, wireline or the like. The tool body is extended into the side pocket mandrel sufficiently so that the distal end of the tool body is located at an elevational position below the gas lift valve to be removed. A valve removal arm extend laterally from the tool body and into the lower end portion of the side pocket portion of the side pocket mandrel, at a position directly below the gas lift valve. The tool body is lifted until the valve removal arm engages the bottom of the gas lift valve. Continued application of tension to the wireline lifts the tool body and the valve removal arm that is engaged with the bottom of the as lift valve, thus dislodging the stuck gas lift valve from the side pocket portion of the side pocket mandrel.

20 Claims, 3 Drawing Sheets

METHOD AND APPARATUS FOR REMOVING GAS LIFT VALVES FROM SIDE POCKET MANDRELS

BACKGROUND OF THE INVENTION

1. Field of the Invention

The present invention relates to downhole oil and gas well tools and more particularly relates to an improved downhole oil well tool that can be lowered on a wireline into the well bore for removing a gas lift valve, that is stuck in a side pocket mandrel. Even more particularly, the present invention relates to an improved method and apparatus for removing a stuck gas lift valve from a side pocket mandrel in an oil and gas well wherein a tool body is run into the well bore on a wireline and pressure is applied with a valve removal arm to the bottom of the stuck gas lift valve. The valve removal arm movably extends from a retracted position within the tool body housing to an exposed position that allows it to engage the bottom of the gas lift valve during the removal step.

2. General Background

In the production of oil and gas wells, it is known to employ gas lift valves that assist in the transmission of oil and gas products from the surrounding formation to the surface. Injection of pressurized fluids in combination with the gas lift valve accomplishes this task in a manner well known in the art. The gas lift valves are placed at intervals along the well bore (i.e. different elevations).

Gas lift valves are retrievable devices that are placed downhole in a section of well tubing that is called a side pocket mandrel. Side pocket mandrels are known in the art and have been used commercially for a number of years. During operation, gas lift valves are placed inside the side pocket portion of the mandrel. Such valves can typically be used either for continuous or intermittent flow gas lift production.

One particular type of side pocket mandrel uses an orienting sleeve. This orienting sleeve provides precise alignment and insertion of side pocket devices into the mandrel side pocket. For example, the orienting sleeve allows gas lift valves to be accurately positioned with respect to any radial position so that they quickly register into the side pocket of the mandrel.

One company that manufactures and sells gas lift valves and side pocket mandrels is Camco, Incorporated of Houston, Tex. A prior art publication that shows many gas lift valves and side pocket mandrels is the Camco catalog entitled "Gas Lift Product Catalog", copyrighted in about 1987.

In a typical oil and gas well, there can be a number of side pocket mandrels spaced at different elevations within the well. Each of these side pocket mandrels can carry a gas lift valve as is known in the art. In normal well operations, a problem arises when one of the gas lift valves becomes inoperable and stuck so that it can not be serviced or replaced. A common problem that prevents removal of a gas lift valve occurs when the top end portion of the valve becomes either bent or broken. If the gas valve is not broken or stuck, it can be grabbed at its top end and removed. If the top of a gas lift valve becomes broken, such prevents conventional removal with a pulling tool.

SUMMARY OF THE INVENTION

The present invention provides an improved method and apparatus for retrieving gas lift valves that have been stuck in the side pocket of a side pocket mandrel. The method of the present invention provides a tool body that is run into the well bore on an elongated tensile support such as a wireline for example.

At least the lower end portion of the tool body extends into the side pocket mandrel sufficiently so that the distal end of the tool body is located at an elevational position below the lower end of the gas lift valve to be removed.

A laterally extending valve removal arm on the tool body is extended into the lower end of the side pocket portion of the side pocket mandrel, and at a position below the stuck gas lift valve. Once this valve removal arm is positioned, the tool body is lifted by applying upward pressure (tension) to the wireline so that the valve removal arm engages the lower tip end of the gas lift valve. Continued upward movement of the wireline engages the valve removal arm with the lower end of the gas lift valve and pushes the gas lift valve upwardly relative to the side pocket mandrel.

This application of pressure to the bottom of the gas lift valve via the valve removal arm and wireline dislodges the stuck gas lift valve from the side pocket of the side pocket mandrel.

In one embodiment, a plug is deposited in the side pocket after the valve arm dislodges the gas lift valve. The plug can be used to prevent the gas lift valve from returning to its stuck position under the influence of gravity.

Once the gas lift valve is dislodged from its stuck position, the laterally extending valve arm is retracted back into the tool body. The tool body is then lifted upwardly in the well bore to a position that allows the top of the gas lift valve to be grabbed with a commercially available pulling tool that is carried by a lower section of the tool body. The damaged or stuck gas lift valve can then be pulled to the surface for replacement.

As part of the method of the present invention, the tool body can be properly oriented so that the valve arm extends along a radial line that conforms with the radial position of the gas lift valve that is stuck. This orientation places the valve removal arm in an aligned position with the central axis of the side pocket portion of the side pocket mandrel and with the central longitudinal axis of the lift valve.

In the preferred embodiment, the tool body includes at least one joint for forming an angle between two adjacent tool body sections and further comprising a step of forming an angle between the two adjacent sections of the tool body at the joint. The bottom of the tool body connects to the gas lift valve after the gas lift valve has been dislodged using this jointed section of the tool body in combination with a commercially available pulling tool that is attached thereto.

In the preferred method, the tool body has an outer surface and a valve removal arm portion that moves between folded and extended positions relative to the tool body outer surface. The tool body includes a hollowed barrel portion and an inner mandrel mounted within the barrel.

The tool body has a guide portion extending radially therefrom. The guide portion registers with a slot on the side pocket mandrel for radially orienting the tool body properly before operation to remove the stuck gas lift valve.

As part of the method of the present invention, the longitudinally measured distance between the guide and the valve removal arm is calibrated before operation begins.

In the preferred method and apparatus of the present invention, the valve removal arm is a pivoting structure that folds into a folded or retracted position when the tool body engages any structure such as the top end portion of the side pocket mandrel as the apparatus is being run into the well. The valve removal arm is spring loaded to fold into the retracted position when the diameter of the well bore is too small to accommodate the valve removal arm and the tool body.

When the valve arm reaches the side pocket mandrel and is properly oriented using the mandrel alignment slot and tool body guide, the valve arm spring forces the valve removal arm into an extended position that allows the valve removal arm to extend into the side pocket portion of the side pocket mandrel so that the arm can engage the bottom of the stuck gas lift valve.

The present invention thus provides an improved apparatus for removing a gas lift valve that is stuck in the side pocket mandrel of an oil and gas well. The apparatus includes an elongated tool body having upper and lower end portions. The upper end portion of the tool body provides a connection for forming an attachment with a wireline so that the tool body can be lowered into an oil and gas well with the wireline.

The tool body includes a valve arm for dislodging a stuck gas lift valve that is positioned in a side pocket of the side pocket mandrel portion by engaging the bottom of the gas lift valve when the tool body is lifted with the wireline.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figures 1A, 1B, 1C:
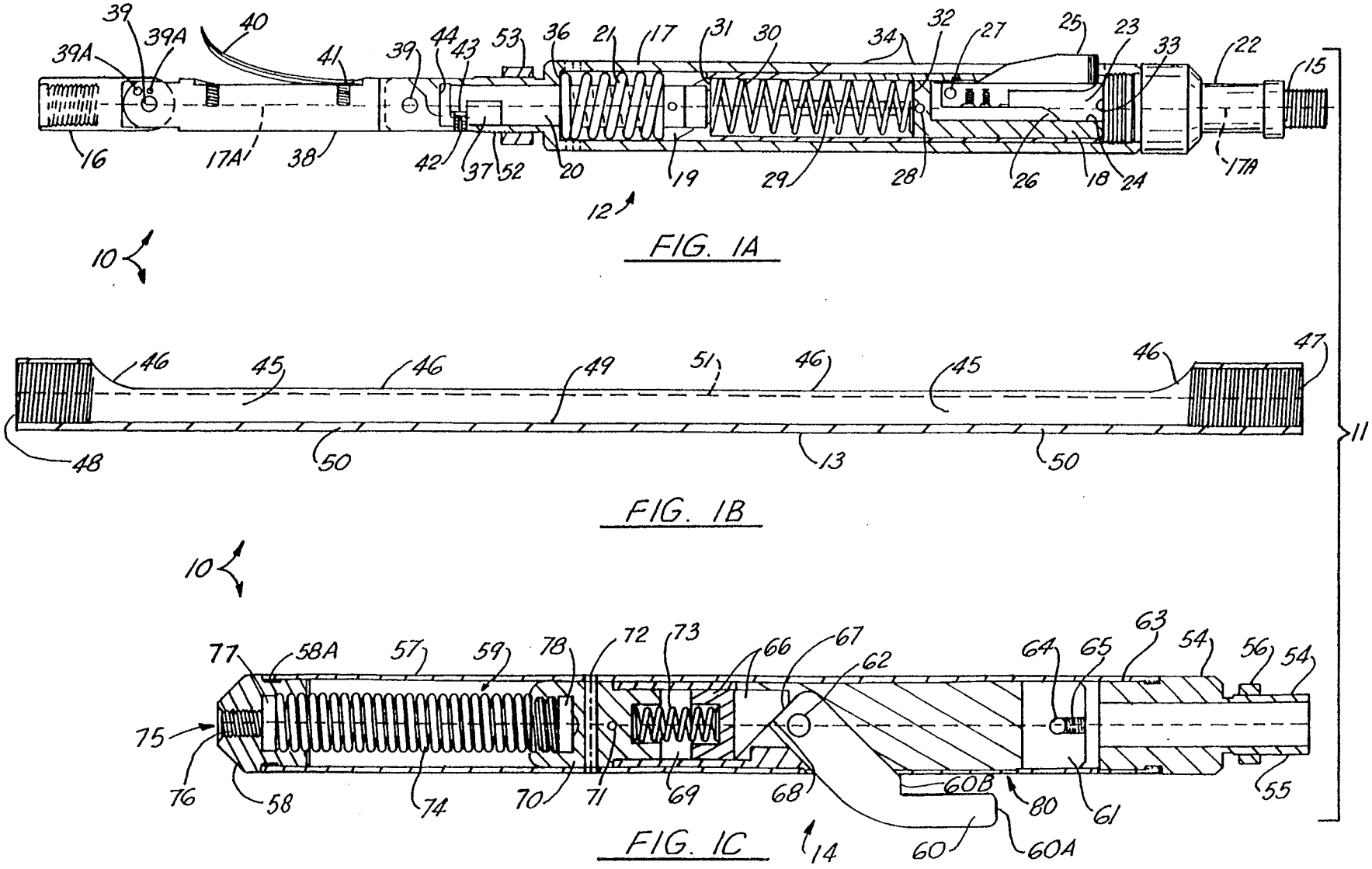
FIG. 1A is a partial sectional view of the preferred embodiment of the apparatus of the present invention showing the tool upper section.
FIG. 1B is a partial sectional view of the preferred embodiment of the apparatus of the present invention showing the tool middle, barrel section.
FIG. 1C is a partial sectional view of the preferred embodiment of the apparatus of the present invention showing the tool lower section and its valve removal arm.
Figure 3:
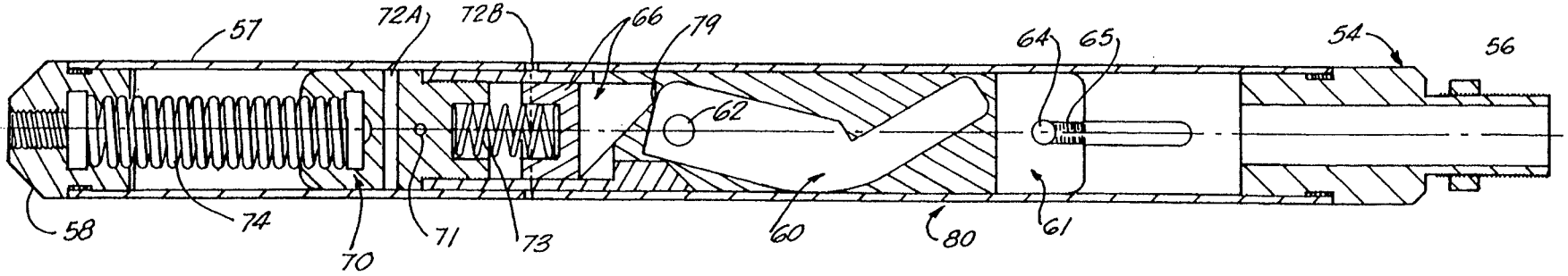
FIG. 3 is a partial sectional view of the preferred embodiment of the apparatus of the present invention showing the tool lower section in sheared position.
Figure 2A:
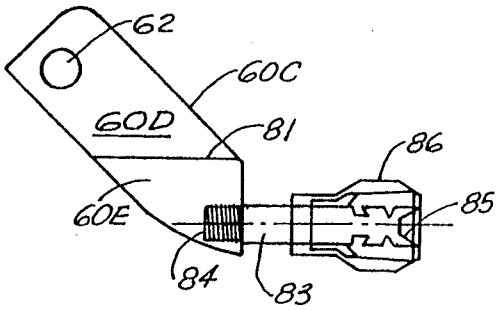
FIG. 2A is a fragmentary view of an alternate embodiment of the present invention of an alternate construction of the valve removal arm.
Figure 2:
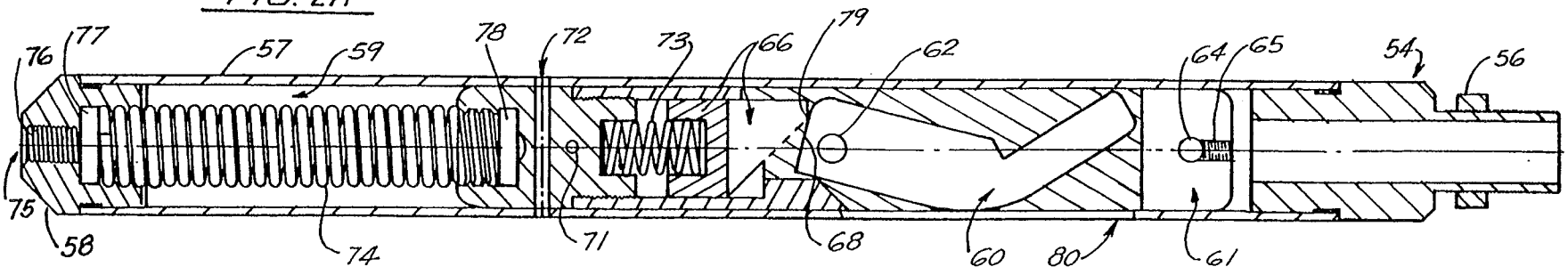
FIG. 2 is a partial sectional view of the preferred embodiment of the apparatus of the present invention showing the tool lower section in an "in tubing" running position.

FIGS. 1–3 show generally the preferred embodiment of the apparatus of the present invention designated generally by the number 10. Downhole oil well tool 10 that is used for the removal of stuck gas lift valves includes an elongated slender tool body 11 that includes basically three sections. Tool body 11 has an upper section 12 that attaches directly to a wireline at connection end portion 15. Tool body 11 also includes a central or barrel section 13 that is hollowed, providing an elongated cylindrical bore for holding a portion of the lower tool section 14 as will be described more fully hereinafter.

Lower section 14 has an arm lower sub 16 defining a connection end portion that attaches to any commercially available tool puller (not shown) that is known and used in the art for attaching to small items in a well. A commercially available tool puller such as, for example model "JDC" or "Modified JDC" available from D & D Sales and Service, Inc. of Des Allemandes, La. could be attached to connection end portion 16. Such a tool puller can be used to lift the stuck gas lift valve after it has been dislodged using apparatus 10 of the present invention and the method of the present invention. It should be understood that commercially available tool pullers attach to the top of the gas lift valve during retrieval. The present invention uses a valve removal arm portion to engage the bottom of a stuck gas lift valve.

Upper section 12 includes finger housing 17 that contains inner cage 18 and outer cage 19. Release plunger 20 is also disposed within housing 17. Release plunger 20 is connected to finger outer cage 19 and travels therewith. Release plunger coil spring 21 surrounds a portion of plunger 20 as shown in the drawings. The upper end of upper tool section 12 includes a fish neck portion 22 so that the tool 10 can be removed by gripping the fish neck 22 if desired.

A recess 23 portion of the finger inner cage 18 carries locating finger 25. Recess 23 includes a flat surface 24 that defines a stop for limiting downward movement of finger 25. Finger spring 26 biases finger 25 into the extended position shown in FIG. 1. The finger 25 is a locating finger that can be registered with an orienting guide shoe GS that is typically found on a commercially available side pocket mandrel M (see FIGS. 4–7).

The tool 10 is lowered into the well with the wireline. The finger 25 collapses upon spring 26 when constrictions in the well are engaged. When the locating finger 25 is positioned adjacent the orienting guide shoe of the side pocket mandrel M, the locating finger 25 registers in the slot and properly orients the tool body 11 with respect to a radial position. This orientation locates the valve removal arm 60 in a position that is radially aligned with the side pocket SP of the side pocket mandrel M and the contained gas lift valve G. This is accomplished by simply placing the valve removal arm 60 on tool body 11 one hundred eighty degrees (180°) with respect to locating finger 25.

Finger 25 pivots about finger pivot 27. Finger 25 slides longitudinally with inner cage 18. Finger cage alignment pin 28 travels in a pair of opposed slots 29 of finger outer cage 19. A slot 34 in housing 17 allows finger 25 to travel with finger inner cage 18.

Finger inner cage spring 30 is a coil spring that extends between shoulder 31 and flat surface 32. A flat surface 33 at the lower end of fish neck 22 adjacent recess 23 engages finger inner cage 18.

Release plunger spring 21 extends between finger outer cage 19 and annular surface 36 of finger housing 17. Release plunger 20 includes a recess portion 37 that cooperates with knuckle arm 38 for allowing the knuckle arm to pivot relative to housing 17. This is accomplished by movement of release plunger 20 toward engagement with flat surface 44. Knuckle arm 38 pivotally attaches to the lower end of finger housing 17 at arm pinned connection 39. Knuckle arm spring 40 bears against the inner wall 49 of barrel or central section 13 of tool body 11 in order to accomplish this pivoting. However, until the travel of release plunger 20 is complete so that its lower end bears against surface 44, set screw 42 prevents any pivoting of knuckle arm 38 about pinned connection 39 and with respect to the central longitudinal axis 17A of finger housing 17. Pivoting is prevented because set screw 42 bears against surface 43 in the normal position that is shown in FIG. 1A.

Only after the gas lift valve G has been removed and upper pressure is applied with the wireline does release plunger 20 bear against surface 44, causing knuckle arm 38 to pivot. A pivoting of knuckle arm 38 moves arm lower sub 16 and attached pulling tool (not shown) to a position that is laterally spaced away from axis 17A so that the pulling tool can grab the top of the gas lift valve after it has been dislodged (see FIG. 7).

In order to dislodge the gas lift valve G from its position within the side pocket SP of side pocket mandrel M, valve arm 60 is employed. Valve arm 60 forms a portion of lower tool section 14 that attaches to the lower end of barrel 13 at threaded cylindrical bore 48. The opposite or upper end of barrel 13 attached to upper tool section 11 by threaded connection between threaded cylindrical bore 47 of barrel 13 and external threads 52 of housing 17.

Upper lock ring 53 can form a tight wedge connection between barrel 13 and finger housing 17 by applying torque to upper lock ring 53 after threaded cylindrical bore 47 is threadably engaged with threads 52. Barrel 13 includes a cylindrically shaped bore 45 surrounded by a generally cylindrical wall 50. However, a cut-out portion 46 forms a longitudinally extending opening or slot in barrel wall 50 for allowing knuckle arm 38 to pivot away from the central longitudinal axis 51 of barrel 13 which is collinear with the central longitudinal axis 17A of finger housing 17 and of upper tool section 12.

Lower tool section 14 provides an upper end portion 54 having external threads 55 for forming a threaded connection with the threaded cylindrically bore 48 of barrel 13. Lower lock ring 56 forms a wedge type connection by threadably engaging threads 55 and the lower end of barrel 13 upon assembly.

Tool body lower section 14 includes outer housing 57 that threadably attaches at connection 58A to bottom sub 58. Housing 57 provides an inner hollow longitudinally extending bore 59 that contains inner housing 61 and its valve removal arm 60 that is pivotally attached thereto at pinned connection 62.

Threaded connection 63 joins sub 54 to outer housing 57. Inner housing 61 carries an inner housing slide pin 64 that registers in a pair of opposed slots in housing 57 for maintaining alignment of inner housing 61 with outer housing 57 during use. Set screw 65 secures inner housing slide pin 64 during use.

Rotator block 66 extends between inner housing 61 and rotator block spring 73. Rotator block 66 provides a diagonally extending surface 67 that fits a corresponding diagonally extending surface 68 on valve removal arm 60 as shown in FIG. 1C. There is a space 69 between rotator block 66 and inner housing bottom sub 70. Inner housing retainer pin 71 maintains sub 70 in a desired position that is longitudinally aligned with housing 57. Pin 71 travels in a pair of opposed slots provided in housing 57.

Shear pin 72 extends through sub 70 and into a pair of spaced apart openings in housing 57 as shown in FIGS. 1C and 2. In FIG. 3 the pin 72 has been sheared, showing pin sections 72A and 72B after shearing takes place. Rotator block spring 73 extends between rotator block 66 and sub 70. Another spring is retractor spring 74 that extends between sub 70 and bottom sub 58 as shown in FIGS. 1C, 2 and 3.

An opening 75 allows a elongated threaded mandrel to be placed into opening 75 and into the bore 59 of housing 57, and specifically through the center of coil retractor spring 74. The threaded member allows the spring 74 to be expanded to the position shown in FIG. 2 so that pin 72 can be placed through housing 57 and inner housing bottom sub 70. The stretching of spring 74 is accomplished by means of thrust washers 78 and 77 which bear against opposing ends of spring 74.

When the user rotates the threaded mandrel (not shown) one skilled in the art will note that the thrust washer 78 moves away from the thrust washer 77 until pin 72 can be placed into the position shown in FIG. 2. In FIG. 2, the opening 75 is shown as being threaded with thread 76. An elongated threaded mandrel would similarly provide external threads that match and intermesh with internal thread 76 of bottom sub 58.

Valve removal arm 60 can pivot between the exposed, operative position of FIG. 1C and retracted position as shown in FIGS. 2 and 3. In FIG. 2, the valve removal arm 60 has collapsed through slot 80 and is within the confines of housing 57. In this position however, an arm 79 portion of rotator block 66 engages surface 68 of valve removal arm 60 at a position that is off-set from arm pivot 62, generating a moment. This moment urges the valve arm 60 back into the operative position of FIG. 1C.

In FIG. 2, the running position of the tool body shows the valve removal arm 60 when it has folded, compressing spring 73 such as when arm 60 engages a restriction of reduced diameter. For example, the top portion of a side pocket mandrel M can be of a smaller diameter that requires collapsing of valve removal arm 60 as shown in FIG. 2.

In FIG. 1C, the valve removal arm 60 is in an operative position. In this position, the tip 60A is spaced away from housing 57 so that the tip 60A can engage the bottom of the gas lift valve G to be removed.

After removal, the operator continues to lift up on the tool body so that pressure is applied to surface 60B shearing pin 72 so that it breaks into pieces 72A and 72B as shown in FIG. 3. In this position, the valve arm 60 fully collapses within the housing 57 as shown in FIG. 3 so that the entire apparatus can be removed. During removal, it would be undesirable for arm 62 to assume the extended position of FIG. 1C. By shearing the pin 72, the removal position of FIG. 3 occurs, preventing spring action from urging the arm 60 outwardly.

In performing the method of the present invention, the user first determines the type and specification (eg manufacturer, model, number, configuration, dimensions) of side pocket mandrel that contains the broken gas lift valve G. This information is typically available from records that are keep of casing, mandrels, and the like. These records are made when such equipment is installed in the well at the time the well is constructed.

The type of side pocket mandrel M determines the length between finger 25 and valve removal arm 60. This length can be adjusted by moving the position of tool body upper section 12 relative to barrel 13 and tool body lower section 14 relative to barrel 13. The adjustment is achieved by rotating the respective upper or lower tool body section 12, 14 and more particularly the threads 52 or 55 thereof respectively with corresponding female threads 47, 48 of barrel 13 once the tool is assembled.

Figures 4, 5, 6, 7:
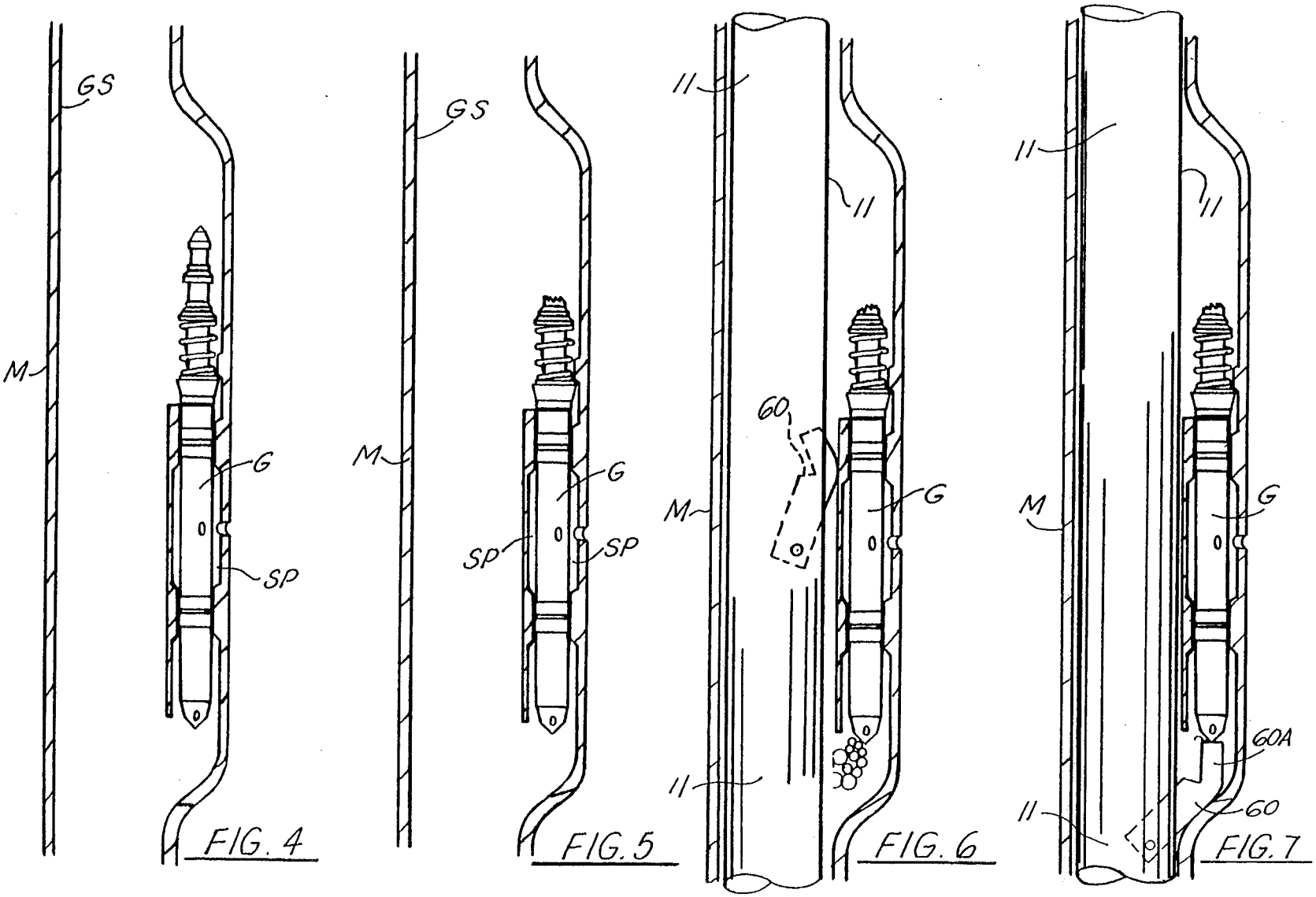
FIGS. 4–7 are elevational views illustrating the preferred method of the present invention for removing a stuck gas lift valve from a side pocket mandrel.

After the desired distance between finger 25 and valve removal arms 60 is achieved, lock nuts 53 and 56 are tightened against barrel 13 to rigidify the three sections 12–14 into a single tool body 11. Once assembled, the entire tool body 11 is attached to a standard wireline stem so that the tool body 11 can be lowered into the well with a wireline. FIG. 4 shows a typical side pocket mandrel M with guide shoe GS, side pocket SP and a contained gas lift valve G. FIG. 5 shows a gas lift valve G that has been broken at its upper end. Such a broken valve G is difficult to remove because it is often bent, binding with the side pocket SP.

When it is determined that a valve G is stuck and must be removed, the tool body 11 is lowered to the side pocket mandrel M that contains the broken gas lift valve G. The tool body 11 then enters that mandrel until the valve removal arm 60 is positioned below the bottom of the gas lift valve to be removed (see FIG. 7). The operator then lifts up on the wireline and tool body 11. In so doing, finger 25 hits guide shoe GS. Such guide shoes GS are typically found on side pocket mandrels M for the purpose of orienting tools that are used to place the gas lift valve in a side pocket SP of mandrel M to begin with. Thus, it should be understood that the side pocket mandrel M and its guide shoe GS are commercially available and known structures. Finger 25 locks into the guide shoe GS at the top of the mandrel M. This method step orients the finger 25 one hundred eighty degrees (180° ) in a circumferential direction from the gas lift valve G to be removed. This also aligns the valve removal arm 60 with the bottom of the gas lift valve G to be removed.

The operator then pulls upwardly with the wireline registering the valve removal arm 60 with the bottom of the gas lift valve to be removed (FIG. 7). Continued upward movement of the wireline and the tool body 11 drives the valve G to be removed upwardly dislodging it from the side pocket portion SP of the side pocket mandrel M. This method step places the top portion of the gas lift valve in a more exposed position so that it can be removed with a selected, commercially available pulling tool (not shown) that is threadably attached to arm lower sub 16.

The operator continues to lift up on the tool body 11 which shears pin 72. The tool body then assumes the position shown in FIG. 3. The tractor spring 74 relaxes, pulling inner housing 61 down to the position shown in FIG. 3, retracting valve removal arm 60 within outer housing 57 as shown in FIG. 3. The tool body can now be lifted upwardly so that the knuckle arm 38 registers with the cutout 46 portion of barrel 13. Spring 40 pushes knuckle arm 38 into a bent position so that the arm lower sub 16 and its pulling tool can grab the top of the gas lift valve G that has been dislodged. Mounting screw 41 supports spring 40 which is a leaf type spring that normally assumes the curved position of FIG. 1A. When the spring 40 bears against wall 50 of barrel 13, knuckle arm 38 can pivot about arm pinned connections 39. The arm 38 extends laterally away from the axis 17A of housing 17 extending away from barrel 13, via cutout 36.

One or more shear pins 39A can be positioned at the joint between knuckle arm 38 and arm lower sub 16. Pins 39A simply maintain knuckle arm 38 in its aligned position with axis 17A before arm lower sub 16 is to reach out and grab the dislodged gas lift valve G.

During use, upward jarring of the tool body 11 (after finger 25 registers with guide shoe GS), and the continued upward pulling on the tool body 11 after arm 60 engages the side pocket SP of side pocket mandrel M shears pins 39A. Pins 39A are smaller diameter pins of a soft brass material so that they shear easily.

FIG. 2A shows an alternate construction of valve removal arm 60. In FIG. 2A, the arm is designated by the number 60C. Arm 60C includes sections 60D and 60E which are connected together at interface 81 with a plurality of brass bolts for example. The bolts can be sized and shaped to define a shearing force that will shear the parts 60D and 60E apart after sufficient load has been applied to the valve arm section 60E with upward wireline force. In the alternate embodiment, this allows the section 60E and grapple 82 to remain in the side pocket SP portion of the side pocket mandrel M. Grapple 82 prevents movement of the broken gas lift valve G back into the side pocket SP.

A threaded rod 83 forms a connection between valve arm section 60E and grapple 82. Rod 83 attaches to valve arm section 60E at threaded connection 84. Grapple 82 includes an internal shaped tip portion 85 of rod 83 opposite threaded connection 84. A lead grapple portion 86 is mounted to shaped end 85. The lead grapple 86 is sized and shaped to fit into and engage the side pocket SP portion of the side pocket mandrel and wedge thereunto so that it frictionally engages the mandrel M at the side pocket mandrel. The grapple 82 prevents the gas lift valve G from falling back into the side pocket SP of the side pocket mandrel M.

The following table lists the parts numbers and parts descriptions as used herein and in the drawings attached hereto.

PARTS LIST

| Part Number | Description |
|---|---|
| 10 | downhole oil well tool |
| 11 | tool body |
| 12 | upper section |
| 13 | central section |
| 14 | lower section |
| 15 | connection end portion |
| 16 | arm lower sub |
| 17 | finger housing |
| 17A | axis |
| 18 | inner cage |
| 19 | outer cage |
| 20 | release plunger |
| 21 | release plunger spring |
| 22 | fish neck |
| 23 | recess |
| 24 | flat surface |
| 25 | finger |
| 26 | finger spring |
| 27 | finger pivot |

-continued

| PARTS LIST | |
|---|---|
| Part Number | Description |
| 28 | finger cage alignment pin |
| 29 | slot |
| 30 | finger inner cage spring |
| 31 | shoulder |
| 32 | flat surface |
| 33 | flat surface |
| 34 | slot |
| 35 | annular surface |
| 36 | annular surface |
| 37 | recess |
| 38 | knuckle arm |
| 39 | arm pinned connection |
| 39A | shear pins |
| 40 | knuckle arm spring |
| 41 | screw |
| 42 | set screw |
| 43 | flat surface |
| 44 | flat surface |
| 45 | bore |
| 46 | cutout |
| 47 | threaded cylindrical bore |
| 48 | threaded cylindrical bore |
| 49 | inside wall surface |
| 50 | barrel wall |
| 51 | axis |
| 52 | external threads |
| 53 | upper lock ring |
| 54 | upper sub |
| 55 | external threads |
| 56 | lower lock ring |
| 57 | outer housing |
| 58 | bottom sub |
| 58A | connection |
| 59 | bore |
| 60 | valve removal arm |
| 60A | tip |
| 60B | surface |
| 60C | valve removal arm |
| 60D | valve removal arm section |
| 60E | valve removal arm section |
| 61 | inner housing |
| 62 | valve arm pin |
| 63 | threaded connection |
| 64 | inner housing slide pin |
| 65 | set screw |
| 66 | rotator block |
| 67 | diagonal surface |
| 68 | diagonal surface |
| 69 | space |
| 70 | inner housing bottom sub |
| 71 | inner housing retainer pin |
| 72 | shear pin |
| 72A | pin section |
| 72B | pin section |
| 73 | rotator block spring |
| 74 | retractor spring |
| 75 | opening |
| 76 | threads |
| 77 | thrust washer |
| 78 | thrust washer |
| 79 | arm |
| 80 | slot |
| 81 | interface |
| 82 | grapple |
| 83 | rod |
| 84 | threaded connection |
| 85 | shaped end |
| 86 | lead grapple |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A method of removing gas lift valves from a side pocket mandrel in an oil and gas well comprising the steps of:

a) running a tool body into the well on a work line, slick line, wireline or the like;

b) extending a portion of the tool body into the side pocket mandrel sufficiently so that the distal end of the tool body is located at an elevational position below the gas lift valve to be removed;

c) laterally extending a valve arm portion of the tool body distal end into the lower end of the side pocket of the side pocket mandrel, at a position below the gas lift valve;

d) lifting the tool body until the valve arm portion engages the bottom of the gas lift valve; and e) applying pressure to the bottom of the gas lift valve via the valve arm portion by lifting on the work line, slick line, or wireline until the gas lift valve is dislodged from the side pocket of the side pocket mandrel.

2. The method of claim 1 further comprising the step between steps "c" and "d" of orienting the tool body so that the valve arm extends along a radial line that conforms with the radial position of the gas lift valve.

3. The method of claim 1 wherein the tool body includes at least one joint for forming an angle between two adjacent tool body sections and further comprising the step of forming an angle between two adjacent sections of the tool body at the joint and connecting the bottom of the tool body to the top of the gas lift valve after the gas lift valve has been dislodged from the side pocket of the side pocket mandrel.

4. The method of claim 1 wherein in step "b" the tool body has an outer wall and the valve removal arm portion moves between folded and extended positions relative to the tool body outer wall.

5. The method of claim 1 wherein the tool body includes a hollowed barrel and an inner mandrel mounted in the barrel.

6. The method of claim 2 wherein the tool body has a guide extending radially therefrom and the guide registers with a slot on the side pocket mandrel during an orientation of the tool body and its finger portion.

7. The method of claim 1 wherein the distance between the guide and valve removal arm is set before step "a".

8. The method of claim 1 wherein in step "b" the valve removal arm folds into the folded position when the tool body engages the top of the side pocket mandrel.

9. The method of claim 1 wherein the valve removal arm extends partially into the side pocket of the side pocket mandrel.

10. An apparatus for removing a gas lift valve from a side pocket of a side pocket mandrel in an oil and gas well wherein the mandrel has a first axis and the side pocket has a second axis generally parallel to the first axis, comprising:

a) a tool body having upper and lower end portions and a central longitudinal axis;

b) means on the upper end portion of the tool body for lowering the tool body into an oil and gas well with a wireline;

c) valve arm means for dislodging a stuck gas lift valve that is in the side pocket of the side pocket mandrel by engaging the bottom of the gas lift valve when the tool body is lifted with the wireline;

d) said valve arm means including a valve arm that is movable between extended and retracted positions, the valve arm being at least partially retractable within the tool body in the retracted position, the valve having a projecting portion that is spaced laterally away from the tool body central axis in the extended position; and e) means for positioning the projecting portion under the side pocket of the side pocket mandrel.

11. The apparatus of claim 10 wherein the tool body has an upper cylindrically shaped member with a first longitudinal axis and the lower end portion is a cylindrically shaped portion with a second longitudinal axis, and further comprising a flexing section disposed between the upper and lower sections.

12. The apparatus of claim 11 wherein the flexing section includes at least one pivoting connection.

13. The apparatus of claim 12 wherein there are two pivoting sections.

14. The apparatus of claim 10 wherein the valve arm means is mounted in the lower section of the tool body.

15. The apparatus of claim 14 wherein the valve arm is mounted in the lower section of the tool body.

16. The apparatus of claim 10 wherein the valve arm is pivotally mounted in the lower section of the tool body.

17. An apparatus for removing gas lift valves from side pocket mandrels in an oil gas well comprising:

a) a tool body having upper and lower end portions;

b) means on the upper end portion of the tool body for lowering the tool body into an oil and gas well with a wireline;

c) valve arm means for dislodging a stuck gas lift valve that is in the side pocket of the side pocket mandrel by engaging the bottom of the gas lift valve when the tool body is lifting with the wireline; and d) means for biasing the valve arm means into the extended position.

18. The apparatus of claim 17 wherein the biasing means includes a spring.

19. The apparatus of claim 18 wherein the spring is mounted within the lower section of the tool body.

20. The apparatus of claim 10 further comprising means for holding the tool body in an aligned position during a lowering of the tool body into an oil well bore wherein the longitudinal axes of the upper and lower body sections are generally aligned.

* * * * *